United States Patent [19]

Galbraith

[11] Patent Number: 4,497,632

[45] Date of Patent: Feb. 5, 1985

[54] INFLATABLE BUOY

[75] Inventor: Lyle D. Galbraith, Redmond, Wash.

[73] Assignee: Rocket Research Company, Redmond, Wash.

[21] Appl. No.: 482,428

[22] Filed: Apr. 6, 1983

[51] Int. Cl.[3] ..... B63B 21/00

[52] U.S. Cl. ..... 441/30; 441/33

[58] Field of Search ..... 441/1, 6, 7, 9, 10, 441/21, 22, 23, 30, 2, 33; 114/52, 54; 102/285, 286, 289; 60/39.823, 39.821, 253, 39.47

[56] References Cited

U.S. PATENT DOCUMENTS

| | | | |
|---|---|---|---|
| 2,968,053 | 3/1946 | Gogolick et al. . | |
| 3,046,925 | 7/1962 | Lisio | 441/31 |
| 3,138,927 | 6/1964 | McSpadden et al. | 60/39.823 |
| 3,229,291 | 1/1966 | Dell'aria et al. | 441/31 |
| 3,382,514 | 5/1968 | Boscov | 441/30 |
| 3,889,224 | 7/1975 | Reed et al. . | |
| 3,921,120 | 11/1975 | Widenhofer | 441/33 |
| 3,977,031 | 8/1976 | Saunders . | |
| 4,094,028 | 6/1978 | Fujiyama et al. | 441/31 |
| 4,186,374 | 1/1978 | Ouellette . | |
| 4,279,025 | 7/1979 | Suppa . | |
| 4,309,786 | 1/1982 | Sharp et al. | 441/30 |

FOREIGN PATENT DOCUMENTS

| | | | |
|---|---|---|---|
| 1088294 | 10/1967 | United Kingdom | 114/54 |

*Primary Examiner*—Trygve M. Blix
*Assistant Examiner*—Edwin L. Swinehart
*Attorney, Agent, or Firm*—Christensen, O'Connor, Johnson & Kindness

[57] ABSTRACT

An inflatable buoy assembly includes a flotation receptacle (12), a propellant breech (14), and an equipment container (16). These three components are designed for telescoping engagement and packaging in a single housing (78). When deployed, the breech is suspended below the flotation receptacle. The equipment container, in turn, is suspended below the propellant breech. As propellant gases escape from the breech, they rise through the water in which the assembly is submersed and are captured in a cavity (26) at the bottom of the flotation receptacle. The gases then pass through apertures in the bottom of the receptacle and are captured within the gas bag (24) forming part of the flotation receptacle.

6 Claims, 9 Drawing Figures

Fig. 5
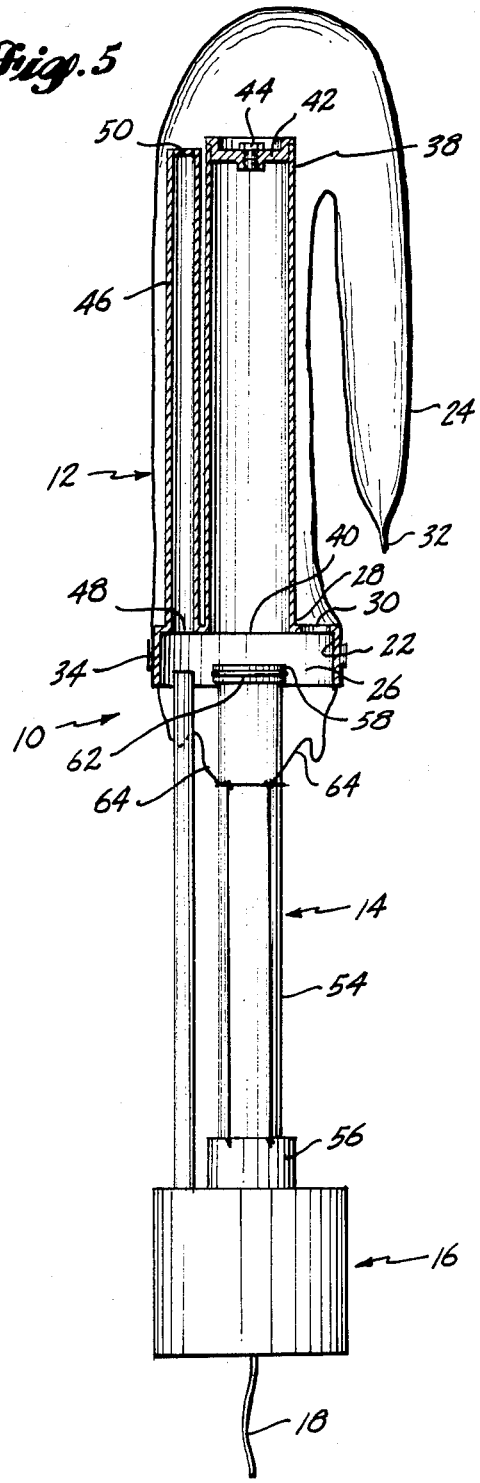
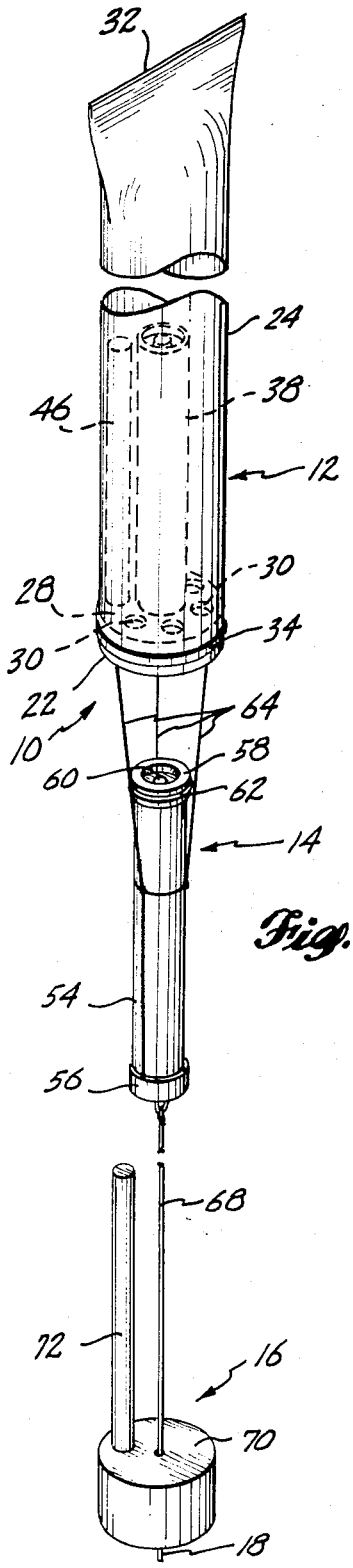
Fig. 1.

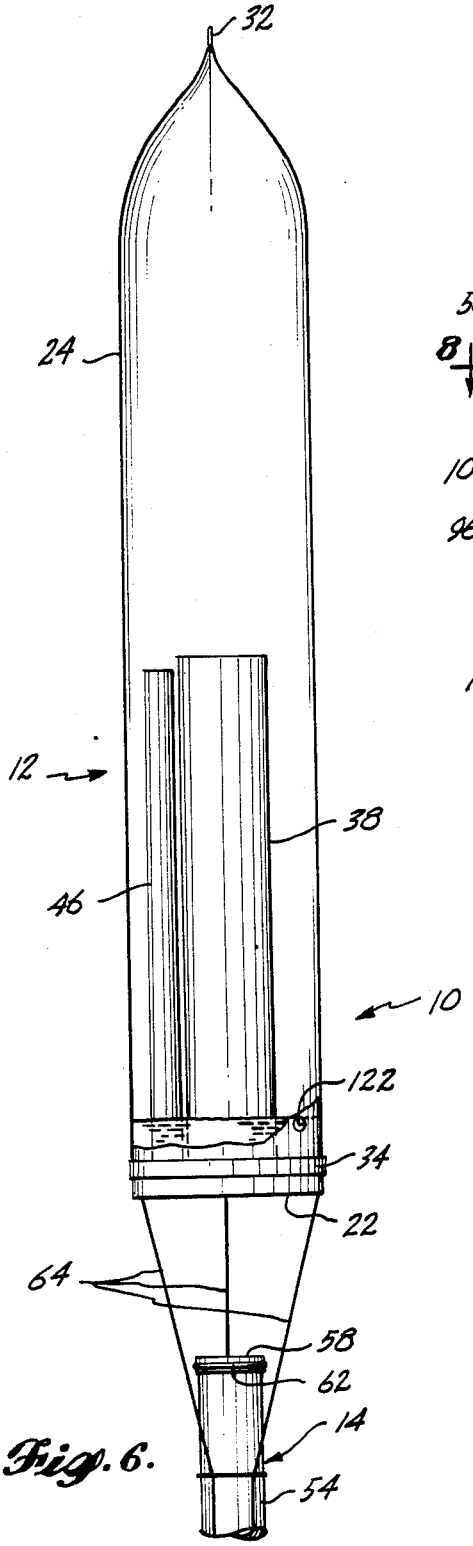
Fig. 6.
Fig. 7.
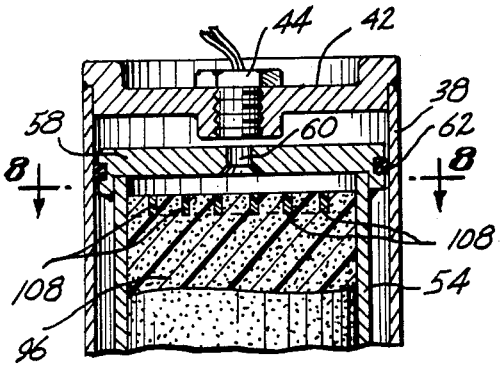
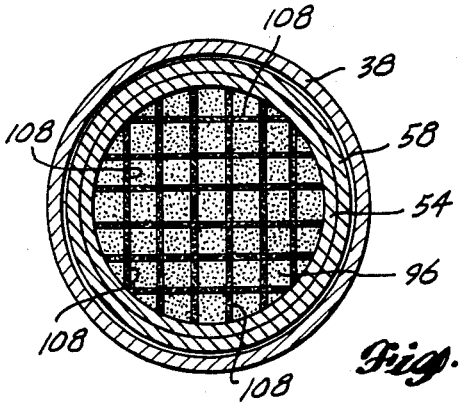
Fig. 8.
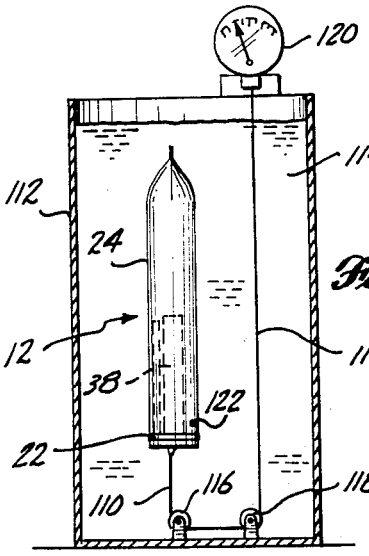
Fig. 9.

INFLATABLE BUOY

BACKGROUND OF THE INVENTION

The present invention relates to inflatable buoys, and more particularly to buoys that can be dropped into a body of water, submerged and inflated below the surface of the water.

Inflatable buoys of the type just described are normally dropped from air for disposition in the water at remote or inaccessible locations. The buoys normally include an inflatable bag, an instrument package, and an anchor that prevents the buoy from drifting with the current. A variety of inflation methods are utilized to inflate the bag, including induction systems in which the bag is inflated during descent from the airplane as well as pressurized gas and propellant charges.

A preferred inflation method is to utilize a propellant charge. However, the burning temperatures of propellants are quite high and can possibly injure a heat sensitive, inflatable bag. As a consequence, means for cooling the propellant have been devised. These means include injecting the propellant into a chamber containing carbon dioxide, pressurizing the carbon dioxide, and when the carbon dioxide reaches predetermined pressure, injecting the carbon dioxide into an inflatable bag. While this system works very satisfactorily, it is desirable to eliminate the extra bulk, weight and expense of a carbon dioxide cooling system, while using conventional gas generating propellants. Other cooling means, such as sensible heat sinks comprised of screens, steel shavings, steel dust, aluminum oxide or magnesium oxide granules consume a significant storage space. Also, passive-type cooling means such as water cooled heat exchangers are bulky and complex.

SUMMARY OF THE INVENTION

The present invention provides an inflatable buoy assembly that employs a propellant to inflate the buoy while eliminating the need for an onboard gas cooling system. The inflatable buoy assembly of the present invention comprises a submersible receptacle means and a gas generating means that is coupled to and suspended below the receptacle means by a suspension means. The submersible receptacle means receives and traps gas being injected into the liquid in which the receptacle means is submersed from a location below the receptacle means. The receptacle means has positive buoyancy upon receiving and trapping a predetermined amount of gas. The gas generating means is positioned below the receptacle means for generating and injecting gas into the liquid at a location below the receptacle means. The suspension means couples the gas generating means to the receptacle means to suspend the gas generating means a predetermined distance below the receptacle means. In a preferred form of the invention, the receptacle means comprises an inflatable bag while the gas generating means comprises a breech holding a propellant charge. When the propellant is ignited, hot, gaseous products are ejected from the breech and allowed to bubble through the liquid in which the recptacle means and gas generating means are located. This liquid is normally water at temperatures slightly above freezing. As the gas bubbles through the liquid, it transfers heat to the liquid, and thus, is sufficiently cooled to prevent harm to the inflatable bag.

In another aspect of the invention, a closure means is associated with the mouth of the submersible receptacle means. The closure means substantially eliminates the gas-water interface while allowing gas rising through the liquid toward the mouth to readily pass by the closure means and be trapped in the receptacle means. In this manner the dissolution of gas from the bag, once inflated, is inhibited, thus slowing or stopping the otherwise inevitable, partial deflation of the buoy.

BRIEF DESCRIPTION OF THE DRAWINGS

A better understanding of the present invention can be derived from reading the ensuing specification in conjunction with the accompanying drawings wherein:

FIG. 1 is an isometric view of a deployed inflatable buoy constructed in accordance with the present invention;

FIG. 5 shows the buoy assembly of the present invention in a further stage of deployment;

FIG. 6 shows the upper portion of the buoy fully deployed and inflated;

FIG. 7 and FIG. 8 are longitudinal sectional and cross-sectional views respectively of the upper portion of the breech assembly showing an ignition promoting material associated with the upper surface of the gas generating propellant; and FIG. 9 is a schematic diagram of an apparatus for calibrating and adjusting the buoyancy of a buoy constructed in accordance with the present invention.

DETAILED DESCRIPTION OF THE INVENTION

Figure 3:
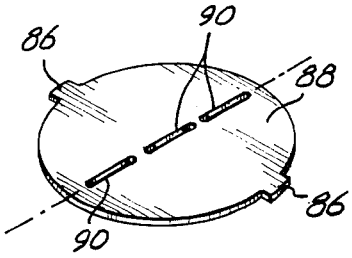
FIG. 3 is an isometric view of a buckle plate employed in conjunction with the container for the buoy shown in FIG. 2.

Referring first to FIG. 1, the inflatable buoy assembly generally designated 10 has four principal components, a flotation receptacle 12, a propellant housing breech 14, an instrument package 16, and an anchor (not shown) suspended below the instrument package 16 from an anchor line 18. In FIG. 1, the buoy assembly is shown in a fully deployed configuration in which the flotation receptacle 12, propellant breech 14, equipment container 16 and anchor are all arranged in a generally vertically oriented string with the flotation receptacle 12 at the top.

Referring to FIG. 1 and adjoining FIG. 5 showing the assembly in a partially deployed form, the flotation receptacle has two principal components, a collector base 22 and a flexible, inflatable bag 24. To conserve drawing space, the bag 24 is shown in FIG. 1 as partially cut away. The collector base 22 is a generally cylindrical shell defining a downwardly opening bell-shaped cavity 26. The upper wall 28 of the collector base carries a plurality of apertures 30, which place the cavity 26 in communication with the upper surface of the collector base 22. The gas bag 24 has an upper end 32 that is closed. The lower end of the bag 24 has a mouth, the circumference of which is substantially the same or slightly larger than the circumference of the collector base 22. The mouth of the bag fits over the collector base. An attachment band 34 is tightened around the outside of the bag to secure and seal the mouth of the bag to the circumference of the collector base 22. Thus, any gas entering the cavity 26 will pass from the cavity through the apertures 30 into the interior of the bag 24 and be trapped therein.

The bag can be made from a variety of flexible, relatively gasimpermeable materials. A number of different synthetic polymers are satisfactory; however, the currently preferred material is a polyester film having a thin layer of aluminum or other material deposited thereon. This material is a thermoplastic on which heat sealed seams can be used to easily and inexpensively form a bag of desired shape and size.

In this embodiment of the invention, a tubular member hereafter referred to an an extender tube 38 extends upwardly from the upper wall 28 of the collector base 22. The extender tube 38 is axially orientated relative to base 22. The bottom end of the tube 38 opens into the cavity 26 through an opening 40 having a diameter equal to the inside diameter of the tube 38. An extender tube cap 42 is secured to the upper end of the extender tube 38 in sealed relationship. The central portion of the cap 42 carries a threaded bore into which can be threaded a squib 44 or igniter for the propellant. The operation of the squib 44 will be better understood when reading the more detailed description of the operation of the buoy set forth later.

Also in this embodiment, a second tubular member 46 extends upwardly from the upper wall 28 of the collector base 22. The second tube 46 is substantially parallel to the extender tube 38 and is positioned radially outwardly from the extender tube. The interior of the tube 46 communicates with the cavity 26 through an opening 48 having a diameter substantially the same as the inside diameter of the tube 46. A cap 50 seals the upper end of the tube 46. As will be understood later, tube 46 serves as a shroud for an elongated electrical device forming part of the equipment package.

Still referring to FIG. 1, the breech 14 comprises a hollow, cylindrical container 54 having a breech base 56 that closes the bottom of the breech 14. A breech cap 58 is fitted over the upper end of the container 54, as will be described in more detail below. A central aperture in the cap forms a nozzle 60 through which propellant gases can escape. The outer periphery of the cap 58 carries an annular groove into which is inserted an O-ring 62. As shown in FIG. 1, the breech 14 when fully deployed is suspended below the flotation recptacle 12 from three ropes or cables 64. The bottom ends of the cables are fastened to fastening points on the breech that are located above the center of gravity of the breech so that the nozzle 60 is always pointing in an upward direction. The three connection points are equally spaced about the circumference of the breech container 54. The ropes extend upwardly from the breech and are fixed by conventional means to the collector base 22 at equally spaced locations along the lower edge of the collector base. Thus, the nozzle 60 of the breech is spaced suspended at a predetermined location below the bell-shaped cavity 26 when the mechanism is fully deployed.

The equipment package 16 is suspended by another rope or cable 68 from the bottom of the breech 14. The equipment container includes a cylindrical can 70 and a rod-like electrical device 72 that extends upwardly from the upper surface of the can 70. The electrical device is offset from the center of the can 70, but is oriented substantially parallel with the can axis. As previously described, an anchor line 18 is coupled to the bottom of the equipment container and extends downwardly to an anchor (not shown).

Figure 2:
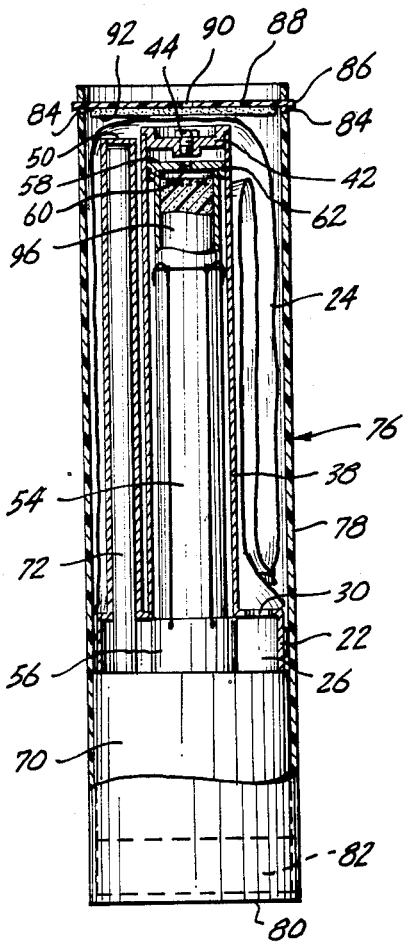
FIG. 2 is an elevation view in partial cross-section of a buoy constructed in accordance with the present invention assembled and ready for deployment.

Referring now to FIG. 2, the entire apparatus is shown in its assembled predeployment form, housed in a hollow container 76. The container 76 in this embodiment is a cylindrical shell having side walls 78, and a bottom wall 80. The top of the container 76 is open. The anchor and anchor line are housed in the bottom of the container 76 in the storage cavity 82 immediately above the bottom wall 80 of the container 76. The container 76 is sized to receive the equipment container 16 in reciprocating or sliding relationship. The breech 14 rests on the top wall of the cylindrical can 70 that forms part of the equipment package with the connecting rope 68 (not shown in FIG. 2) coiled adjacent the breech base 56.

Once the breech 14 is in position, the flotation receptacle 12 can be positioned within the container 76. Again, the exterior dimensions of the collector base 22 are sized to be reciprocally received within the container 76. The extender tube 38 is also sized to reciprocally receive the breech 14. The cap 58 and O-ring 62 are sized so that the O-ring 62 contacts the interior walls of the extender tube 38 in sliding, sealing relationship as the breech 14 is telescoped into the extender tube 38. At the same time the breech is received into the extender tube 38, the electrical device 72 is received by the electrical device shroud tube 46 forming part of the flotation receptacle. Prior to inserting the flotation receptacle 12 into the container 76, the inflatable bag 24 is deflated and folded along one side of the extender tube 38. In this manner, the entire assembly is compactly positioned within the container 76.

The container walls extends upwardly beyond the upper end of the extender tube and the folded bag 24. Adjacent the top end of the container 76, a pair of diametrically opposed slots 84 are provided. These slots receive diametrically outwardly extending tabs 86 on a buckle plate 88 shown in FIG. 3. The buckle plate comprises a disc carrying the tabs 86. The disc has a diameter slightly less than the interior diameter of the container 76. On a diameter orthogonal to the diameter in which the tabs 86 are located, the buckle plate is provided with a series of slots 90. These slots form a zone of weakness along the length of the slots. The tabs 86 are inserted into the slots 84 by bending the central portion of the buckle plate upwardly along the zone of weakness. This reduces the distance between the ends of the slots 86 allowing them to be inserted into the interior of the container 78 positioned beside the tabs 86. The plate is again flattened out to cause the tabs 86 to be inserted into the slots 84. In this manner, a blow-away cover or top plate is provided for the container 76. Prior to inserting the buckle plate 88 into the container, a foam pad 92 is positioned over the top of the bag 24 to protect the bag during deployment of the inflatable buoy assembly.

In operation, the inflatable buoy 10 is assembled and packaged in the container 76 as just described. In this condition, the inflatable buoy is ready for deployment from an aircraft or by other means. If deployed from an aircraft, a parachute can be attached to the buckle plate or otherwise affixed to the container 76 to slow the descent of the assembly to the surface of the water. Once the assembly has submerged, it will begin to sink. Normally, the squib 44 is activated by a pressure sensitive electrical contact which fires the squib when the assembly has reached a predetermined depth. Once the squib 44 is fired, the ouput gas from the squib transfers through the nozzle 60 into the upper portion of the breech 14 where the propellant is ignited.

The porpellant can be conventional, for example, a mixture of nitroglycerine and nitrocellulose, or mixtures of ammonium nitrate and rubber compositions. Other suitable propellants that will ignite and burn under work and high pressure conditions can also be employed. If desired, an ignition promoter can be provided in this region to assure that ignition takes place uniformly and quickly. As ignition of the propellant 96 occurs, hot gases are generated and ejected from the nozzle.

Figure 4:
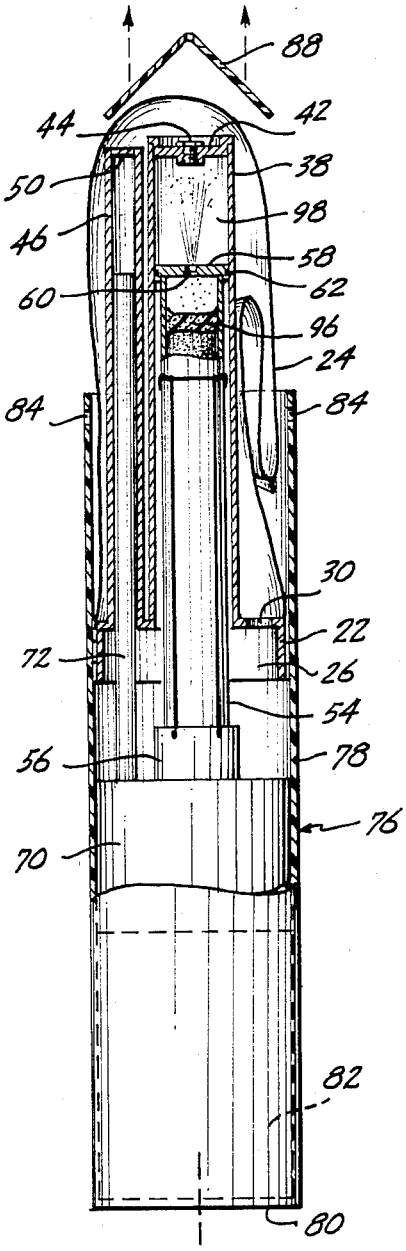
FIG. 4 is a view similar to FIG. 2 showing the inflatable buoy as deployment is begun.

Referring now to FIG. 4, the gases ejected from the nozzle 60 are trapped in the chamber 98 formed between the upper end of the breech 14 and the extender tube cap 42. Gases cannot escape from the interior cavity 98 because the O-ring 62 forms a seal between the extender tube and the breech. As pressure builds in the cavity 98, the flotation receptacle is forced upwardly against the buckle plate 88. The upward force exerted on the flotation receptacle causes the buckle plate 88 to buckle along its zone of weakness blowing it away from the top of the container 76. As this occurs, the buckle plate 88 clears the container while the container begins to fall away from the inflatable buoy assembly. As gas continues to be generated within the breech 14, the pressure continues to increase in the cavity 98 until the breech 14 is completely ejected from the extender tube 38 as shown in FIG. 5.

Once the breech 14 is freed from the extender tube, it will continue to fall away from the flotation receptacle 12 until suspended at a predetermined distance from the flotation receptacle by the suspension ropes 64. At the same time, the equipment package 16 will fall away from the breech 14 until it is suspended below the breech by the connecting rope 68. In this orientation, the breech 14 is positioned below the cavity 26 defined by the collector base 22. The propellant charge in the breech is designed so that gas continues to be generated within the breech 14 and ejected from the nozzle 60 when the breech is suspended below the flotation receptacle. Since the whole assembly is submersed, the gas ejected from the breech 14 intimately contacts the surrounding water. Since the gas is relatively hot, sometimes on the order of 2,000° to 3,000° F., heat transfer occurs rather rapidly, cooling the gas to close to ambient temperatures. As the gas rises from the breech, it is captured within the cavity 26. The gas travels through the apertures 30 into the interior of the bag 24 to inflate the bag. Once the bag is inflated, any excess gas not trapped in the container 26 escapes around the bottom edges of the collector base and travels to the surface of the water.

Referring now to FIGS. 7 and 8, another feature of the present invention will be described. FIGS. 7 and 8 show the upper end of the breech when fully assembled into the extender tube 38. The upper surface of the propellant is situated immediately below the bottom surface of the cap 58 on the breech 14. A plurality of grooves formed in the propellant open upwardly onto the surface of the propellant. Preferrably, the grooves are formed in a waffle or rectangular grid pattern. These grooves are filled with a highly combustible material 108 such as barium cromate or boron-potassium nitrate. When the squib 44 is fired through the nozzle 60, the highly flammable material 108 will begin to burn and promote ignition of the propellant. In this manner, even though propellant ignition might otherwise be inhibited by the cold, aqueous environment in which the inflatable assembly is situated, the ignition promoter will effectively assure full and complete ignition of the propellant.

Referring now to FIG. 9, a schematic diagram of the manner in which the buoyancy of the flotation receptacle is calibrated is illustrated. The flotation receptacle 12 is tied to a cable 110. The entire flotation receptacle is submerged in a tank 112 filled with water 114. The bag 24 is completely inflated. The cable 110 runs downwardly from the flotation receptacle through a first sheave 116 horizontally to a second sheave 118, then upwardly beyond the surface of the water 114. The other end of the cable 110 is connected to a force measuring device such as a scale 120. The value read on the scale corresponds to the buoyancy of the flotation receptacle 12. Since the volume of the bag adjacent the collector base 22 can be calculated, the amount of water displaced by a given length of bag 24 can also be ascertained.

Because of this relationship, the exact volume of the upper end of the bag need not be accurately measured during assembly. Instead, a more than adequate volume can be provided in the bag 24 so as to provide more than a desired amount of buoyancy. Thus, the bag can be formed from a flat sheet of heat sealable material using an inseam at the upper end of the bag and longitudinal seam down one side of the bag. Once the bag is filled and the buoyancy measured as just described in conjunction with FIG. 9, the buoyancy of the bag can be reduced by the desired amount by calculating the height of the bag column not required and punching a small hole 122 in the bag. The hole will allow water to enter the bag up to the level of the hole, thus reducing the volume of the bag and reducing its buoyancy. In this manner, each bag can be calibrated to a predetermined buoyancy value in a relatively short time utilizing relatively simple equipment.

The present invention has been described in conjunction with the preferred embodiment. One of ordinary skill after reading the foregoing specification will be able to effect various changes, alterations and substitutions of equivalents without departing from the broad concepts disclosed herein. It is therefore intended that the scope of protection granted by Letters Patent herein be limited only by the definition contained in the appended claims and equivalents thereof.

The embodiments of the invention in which an exclusive property privilege is claimed are defined as follows:

1. A buoy assembly adapted to be submerged in a liquid and inflated below the surface of the liquid, comprising:

receptacle means comprising a base having a cavity opening in a first, normally downward direction, an inflatable bag having a mouth surrounding and sealed to the base such that the bag can be inflated to extend in a second, normally upward direction from the base, and means forming a tubular recess projecting from the base in the second direction into the interior of the bag, the base having apertures therein communicating between the cavity and the interior of the bag;

gas generating means comprising a breech and a propellant disposed in the breech, the breech having a first end comprising a nozzle, the propellant being capable of generating gas when ignited, the breech being slidably positioned within the tubular recess with its first end in the second direction prior to ignition of the propellant;

suspension means for coupling the gas generating means to the receptacle means such that the gas generating means may be suspended a predetermined distance below the receptacle means; and, the assembly being adapted such that upon ignition of the propellant, the resulting gas causes the breech to move in the first direction out of the tubular recess and become suspended by the suspension means at said predetermined distance below the receptacle means, such that gas thereafter generated by the gas generating means passes from the nozzle, through an unconfined volume of the liquid in which the assembly is submerged, and into the receptacle means to inflate the bag.

2. The assembly of claim 1, further comprising means for creating a gas tight seal between the breech and the tubular recess when the breech is contained within the tubular recess.

3. The assembly of claim 1, wherein the suspension means comprises at least three ropes disposed equidistantly about the breech, the ropes being coupled to the breech above the center of gravity thereof, the ropes extending upwardly and being affixed to the base.

4. The assembly of claim 1, further comprising a payload and means for suspending the payload from the gas generating means.

5. The assembly of claim 4, further comrising an anchor system including an anchor line coupled to the payload.

6. The assembly of claim 1, wherein the bag has a small aperture therein adjacent its bottom but above the base.

* * * * *